United States Patent [19]

Birman et al.

[11] Patent Number: 4,880,479

[45] Date of Patent: Nov. 14, 1989

[54] COLD DRAWN FREE-MACHINING RESULFURIZED AND REPHOSPHORIZED STEEL BARS HAVING CONTROLLED MECHANICAL PROPERTIES AND CONTROLLED MACHINABILITY

[75] Inventors: Stephen P. Birman, Mayfield Heights; Richard B. Smith, Elyria; Richard L. Thompson, Amherst, all of Ohio

[73] Assignee: Stanadyne, Inc., Windsor, Conn.

[21] Appl. No.: 204,308

[22] Filed: Jun. 9, 1988

Related U.S. Application Data

[63] Continuation-in-part of Ser. No. 872,544, Jun. 10, 1986, abandoned.

[51] Int. Cl.[4] ..... C22C 38/60; C22C 38/12

[52] U.S. Cl. ..... 148/320; 420/87; 420/84; 420/127

[58] Field of Search ..... 148/320, 332–336, 148/12.1, 12 F, 12 B; 420/84, 87, 127; 72/274

[56] References Cited

U.S. PATENT DOCUMENTS 4,056,387 11/1977 Cantera et al. ..... 420/84

*Primary Examiner*—Deborah Yee

*Attorney, Agent, or Firm*—Kinzer, Plyer, Dorn, McEachran & Jambor

[57] ABSTRACT

A resulfurized and rephosphorized free-machining steel bar formed by cold drawing a hot rolled steel bar has the composition, by weight, C up to 0.08%; Mn 0.6% to 1.4%; Si up to 0.1%; P at least 0.03%; S 0.25% to 0/50%; Cb 0.02% to 0.10%; the sum of Ni, Cr, Mo and Cu up to 0.15%; balance iron. The ratio of %Mn/%S is from 1.6 to 4.0, and the ratio of $[\%Mn-(1.62\times\%S)]/\%Cb$ is from 2 to 50. The yield strength of the steel bar is further determined by the draft in cold drawing the bar from the hot rolled state and the size and cross section of the bar after draft. The relationship between strength and ductility is further improved by heavy drafting in cold drawing the bar from the hot rolled state.

13 Claims, No Drawings

COLD DRAWN FREE-MACHINING RESULFURIZED AND REPHOSPHORIZED STEEL BARS HAVING CONTROLLED MECHANICAL PROPERTIES AND CONTROLLED MACHINABILITY

SUMMARY OF THE INVENTION

This is a continuation-in-part of copending application Ser. No. 872,544, filed June 10, 1986, now abandoned.

The present invention relates to a free-machining resulfurized and rephosphorized cold drawn steel bar and, more particularly, to such a steel bar having a controlled chemistry and whose yield strength is determined not only by the controlled chemical composition, but also by the size of the bar after hot rolling and the amount of draft used in reducing the bar.

A primary purpose of the invention is a cold drawn free-machining steel bar as described in which mechanical properties of the bar, particularly the relationship between yield strength, tensile strength and ductility, can be determined on the basis of the chemical composition of the bar and applicable draft.

Another purpose is a free-machining cold drawn steel bar as described in which the amount of carbon is reduced accompanied by controlled amounts of columbium, which when accompanied by size-related optimization of the ratios of the ingredients in the chemical composition, provide a means for targeting yield strengths for desired bar application.

Another purpose is a cold drawn free-machining steel bar as described in which the necessary characteristics for increased machinability are optimized by the chemical composition and by the configuration of the bar.

Another purpose is a resulfurized and rephosphorized free-machining steel bar as described having excellent machinability characteristics which are provided by optimizing the relationship between steel chemistry, steelmaking, cold drawing practice and machining conditions.

Another purpose is a process of providing a cold drawn free-machining steel bar utilizing the chemical characteristics of the bar, the size and steelmaking procedures used in the bar, which has application to carbon steel, manganese steel, resulfurized and rephosphorized steel, microalloyed steel and high strength steel.

Another purpose is a cold drawn free-machining steel bar as described in which the amounts and ratios of manganese, sulfur and columbium and the amount and pattern of deformation in cold drawing are controlled to provide optimum machinability.

Other purposes will appear in the ensuing specification and claims.

DETAILED DESCRIPTION OF THE INVENTION

It is well known that certain elements, such as sulfur, lead, bismuth, tellurium and selenium, are useful for improving machinability of steel. Machinability is a complex and not fully understood property. The problem is one in which the effect of the alloy composition, plastic flow of the metal workpiece and cutting dynamics are not readily recognized from the manner in which the alloy is machined by cutting tools in such operations as single point turning, forming, drilling, reaming, boring, shaving and threading. There is a gap in the available knowledge of material behavior between test results obtained from conventional, non-steady-state tension experiments and results obtained from cutting force data derived from in-process machining.

Metallurgists have long sought to improve the machinability of free-machining steel bars by modifying the chemical composition, optimizing size, shape, distribution and chemical composition of inclusions to enhance the brittleness of the chip and increase lubrication at the tool/chip interface. Further, it is desired to prevent formation of the abrasive particles and microconstituents which are in the steel bar. For example, for the purpose of improving machinability varying amounts of one or more such elements as bismuth and tellurium (U.S. Pat. No. 4,236,939); lead, bismuth and tellurium and/or sulfur (U.S. Pat. No. 4,244,737); tellurium and sulfur (U.S. Pat. No. 4,279,646) have been included in resulfurized and rephosphorized free-machining steels. Such products, however, have not completely satisfied the need for increased machinability of free-machining steel. Prior efforts at increasing machinability have been more specifically directed to the chemical composition rather than attempting to optimize the chemical composition, the draft or percentage size reduction in cold forming and the size and cross section of the bar. The present invention is specifically directed to increasing machinability by combining the optimum ratio of chemical ingredients, particularly manganese, sulfur and columbium with optimum size and cross sections for the bar, as well as the amount of cold working. Thus, in the present invention the chemical composition, draft, size and cross section of a bar are tailored to meet particular machinability applications.

The cold drawn free-machining resulfurized and rephosphorized steel bar of the present invention has a chemical composition, by weight, consisting of C up to 0.08%; Mn 0.6% to 1.4%; Si up to 0.1%; P at least 0.3%; S 0.25% to 0.50%; Cb 0.02% to 0.10%; the sum of Ni, Cr, Mo, and Cu up to 0.15% with the balance being iron. The ratio of manganese, sulfur and columbium is particularly important in providing a steel bar of the appropriate chemical characteristics and in predicting the yield strength of a particular bar. Thus, the ratio of % M/% S is from 1.6 to 4.0 and the ratio of [% Mn−(1.62×%S)]/% Cb is from 2 to 50.

The yield strength of the bar, and hence its machinability, is determined by the raw material, size and the draft. The raw material may be, considering the available types of products from the mill, hot rolled coil, hot rolled bars up to 2" in diameter and hot rolled bars having a diameter of at least 2". Such stock, after hot rolling to the specified size, and being cut off in appropriate lengths, will then be cold drawn and the draft or the size reduction in cold drawing is also extremely important in determining yield strength of the finished bar.

Carbon up to 0.08%

Considering the roles of the different chemical elements in the composition and their influence on machinability and performance of the steel, a reduced carbon content is essential for assuring low work hardening and strain hardening of a steel subject to cold drawing and machining. A low carbon content providing low strength in a resulfurized and rephosphorized steel, when combined with the sum of residual elements, such as nickel, chromium, molybdenum and copper not exceeding 0.15%, provides a product of relatively low ductility and increased breakability of the chip formed at the tool-workpiece interface. If the residual elements are increased above the level specified, with the reduced carbon content specified, the product has increased ductility and decreased breakability of the chip, which are disadvantageous in a free-machining product. Moreover, an increase in the carbon content above 0.08% increases the formation of abrasive particles, creates a likelihood of increased fracture stress and an increase of surface hardness, particularly in cold drawn hexagonal bars.

Manganese 0.6% to 1.4%

The specified amount of manganese is important for the formation of manganese sulfide (MnS) based inclusions which exert influence on tool life. Manganese promotes hardenability and increases the strength of cold drawn bars. The actual specification of manganese in a particular bar is dependent upon the diameter of the hot rolled steel, the required mechanical properties for the bar and the machining designation. The manganese content is increased with an increase in the size of bar and an increase in the target level of yield strength.

Silicon up to 0.1%

The silicon content should be limited to 0.1% as an increased amount of silicon substantially increases the amount of abrasive silicates in the finished product.

Sulfur 0.25% to 0.50%

Sulfur is also necessary for the formation of MnS inclusions, and it is for this reason that the sulfur content should be at least 0.25%. The particular specification of sulfur in a particular bar depends on the size of the bar and the manganese content. The minimal sulfur content is utilized with a hot rolled coil as the raw material, whereas the maximum sulfur content is required for large diameter cold drawn bars with increased yield strength up to approximately 80 ksi. An excess amount of sulfur causes hot shortness and low ductility and therefore 0.5% is the upper limit of the sulfur content of the product disclosed herein.

Phosphorus at least 0.03%

Phosphorus is necessary for improving the smoothness of the surface finish. However, phosphorus can increase the work hardening and the hardness of the chip formed in machining. Thus, the amount of phosphorus must be reduced from what is customary in bars of this type (usually up to 0.09%) to permit high speed machining operations in cold drawn steel bars with increased strength.

Columbium 0.02% to 0.10%

Columbium is essential in the present steel to increase strength, control the mechanical properties through the thickness of the bar and to reduce toughness of the chip. The specification of columbium is different for different levels of yield strength and bar size. Columbium promotes hardenability and increases work hardening of the core in large diameter cold drawn bars. Columbium-bearing steel may be cold drawn with reduced draft in order to obtain minimal strengthening of the surface and substantial strengthening of the core. At a higher content than that specified, however, the effect of the columbium is to excessively increase strength and thereby reduce tool life.

Residual elements up to 0.15%

The residual elements of nickel, chromium, molybdenum and copper are generally harmful for machinability because they increase strength and ductility and promote the formation of abrasive particles, all of which detract from the machinability characteristics of a steel. Thus, the residual elements must be kept within the range specified.

The ratio of % Mn/% S should be from 1.6 to 4.0 and this ratio defines the amount of manganese in solid solution and the amount of FeS inclusions.

The relationship between manganese, sulfur and columbium specified as [% Mn−(1.62×% S)]/% Cb defines the relative contributions of manganese and columbium in strengthening the product. Manganese affects strength through changing kinetics of austenite decomposition, whereas columbium decreases grain size and promotes precipitation hardening. The ratios specified will vary depending on the size of the hot rolled product, the amount of draft involved in reducing to a cold drawn product and the desired tensile strength in the ultimate application of the steel bar.

In addition to the elements described, the relationship between mechanical properties and machinability is improved by the addition of one or more of the following: vanadium in an amount, by weight, up to 0.1%; lead in an amount, by weight, of 003% to 0.35%; zirconium in an amount, by weight, of 0.005% to 0.05%; bismuth in an amount, by weight, of 0.05% to 0.25%; lead in an amount, by weight, of 0.03% to 0.15% and bismuth in an amount, by weight, of 0.05% to 0.15%; nitrogen in an amount, by weight, of 0.006% to 0.012%; bismuth in an amount, by weight, of 0.05% to 0.25% and tellurium in an amount, by weight, of 0.005% to 0.05%. Zirconium maximizes machinability by promoting globular-shaped MnS inclusions, whereas nitrogen promotes the breakability of chips which facilitates drilling operations. Vanadium provides for an increase of the surface to center mechanical properties of the steel bar.

In addition to the specific chemistry described, it is important in providing steel bars having the improved machinability characteristics described herein that the bars be subject to enhanced draft when cold drawing from the hot rolled state. Specifically, for steel bars having a hot rolled diameter of over one inch, the draft should be at least ⅛ inch so that a steel bar having a hot rolled diameter of one inch would have a cold drawn diameter of ⅞ inch. Further, for hot rolled products, specifically hot rolled coil, having a diameter in the hot rolled state of less than one inch, the reduction in area through cold drawing should be between 15 and 30 percent of the area of the bar in the hot rolled state. Without the enhanced cold drawing as described, the increased mechanical properties illustrated in the following table are not attainable.

Table 1 illustrates the composition of nine columbium bearing resulfurized and rephosphorized steels and Table 2 illustrates the mechanical properties of these steels after they have been cold drawn to designated sizes and shapes. Also included in Table 2 is a steel designated 12L14 which is a conventional free machining steel having no columbium and carbon in an amount above that specified in the present invention. Table 2 indicates mean mechanical properties for 12L14 steel bars having designated sizes and shapes.

As is evidenced from Table 2, steel bars having the controlled chemistry of the present invention provide substantially higher yield and tensile strengths with substantially no change in ductility as measured by percent elongation and percent reduction in area. Thus, the mechanical properties of steel bars formed in accordance with the present invention are substantially enhanced over conventional steel bars which have no columbium, higher levels of carbon and which do not utilize the substantial draft described above.

In addition to the steels described in Tables 1 and 2, and to illustrate the increased tool life provided by a steel coming within the parameters of the present invention, two additional steels, identified in Table 3 as steels 10 and 11, were prepared with the following composition: steel 10-C 0.09%; Mn 0.96%; P 0.08%; S 0.31%; and Cb 0.005%; steel 11-C 0.08%; Mn 0.92%; P 0.06%; S 0.34%; and Cb 0.12%. Steel 10 had an amount of Cb less than the lower limit of 0.02% specified in the present invention, whereas, steel 11 had an amount of columbium just above the 0.1% specified in the present invention.

Machinability of steel bars which are used in conventional screw machine operations is customarily measured by the toollife of the tools which are performing the machining operations on the bar. Tool life is defined as the elapsed running time during which acceptable parts are manufactured. Increased tool life maximizes running time and minimizes down time, thereby decreasing the machining costs per unit. A steel which approximately doubles tool life dramatically reduces the user's finished product cost.

Table 3 compares the machinability of steels 9, 10 and 11. These three steels in a ⅝ hexagon size were used in the manufacture of a radiator fitting. There is no substantial difference in tool life for a finish forming operation between steels 9 and 10, since in a finish forming operation there is no substantial change in the exterior diameter of the workpiece. In rough forming there is a very substantial change in the exterior diamter of the workpiece and Table 3 illustrates the substantial increase in tool life when using steel 9 as compared with steel 10. The results shown for steel 11 are principally included to show that this steel, with an amount of Cb of more than the 0.1% specified herein, is essentially unsatisfactory for free machining steels.

Twenty thousand pounds each of steels 9, 10 and 11 in a 15/32 round size were used in the manufacture of diesel pump nozzles. Table 3 illustrates that there is no substantial difference in tool life for rough forming, finish forming or cut-off between steels 9 and 10, although there was a very substantial difference in tool life, almost 100 percent, in a drilling operation. Again, Table 3 also indicates that steel 11, which included an amount of columbium of 0.12% was substantially inferior to steel 9.

Typically, an increase in yield and tensile strength in free machining steel bars is accompanied by a decrease in ductility, as measured by percent elongation and percent reduction of area. Optimum yield and tensile strengths are desired for improved surface finishes in which the primary machining operation takes place at the surface of the bar, e.g. a forming operation. Drilling operations are enhanced by an increase in ductility as measured by an increase in percent elongation and percent reduction of area.

The 12L14 steels indicated in Table 2 show typical mechanical properties for free machining steel bars. It is possible to increase the tensile and yield strengths of 12L14 steels through heavy cold drawing, but this is accompanied by substantially reduced ductility, as measured by a reduced percent elongation and a reduced percent reduction of area. The steels of the present invention using controlled amounts of Cb, reduced amounts of C, and increased draft surprisingly provide increased yield strength and tensile strength with no substantial reduction in ductility as measured by percent elongation and percent reduction of area. A steel bar which has both increased yield and tensile strengths without any reduction in ductility has materially enhanced machinability characteristics in that the bar has both the ductility required for drilling and the increased tensile and yield strengths required for forming operations.

Whereas the preferred form of the invention has been shown and described herein, it should be realized that there may be many modifications, substitutions and alterations thereto.

TABLE 1

Chemical Composition of Cb-bearing Resulfurized and Rephosporized Steels

| Steel | Chemical Composition C | Mn | P | S | Si | Cb | Pb |
|---|---|---|---|---|---|---|---|
| 1 | 0.050 | 0.83 | 0.080 | 0.30 | 0.004 | 0.035 | — |
| 2 | 0.050 | 0.83 | 0.080 | 0.30 | 0.004 | 0.035 | 0.285 |
| 3 | 0.042 | 0.85 | 0.053 | 0.29 | 0.003 | 0.030 | 0.311 |
| 4 | 0.063 | 0.84 | 0.062 | 0.32 | 0.002 | 0.025 | 0.258 |
| 5 | 0.040 | 0.83 | 0.048 | 0.35 | 0.008 | 0.041 | — |
| 6 | 0.068 | 0.97 | 0.060 | 0.31 | 0.003 | 0.044 | — |
| 7 | 0.068 | 0.97 | 0.060 | 0.31 | 0.003 | 0.044 | 0.295 |
| 8 | 0.081 | 0.99 | 0.080 | 0.31 | 0.003 | 0.089 | — |
| 9 | 0.05 | 0.83 | 0.050 | 0.30 | | 0.035 | — |

TABLE 2

Effect of Columbium on Mechanical Properties and Machinability of Cold Drawn Bars

| Steel | Cb, % | Pb, % | Size/Shape | Mechanical Properties Yield Strength ksi | Tensile Strength ksi | Elong. % | R/A % |
|---|---|---|---|---|---|---|---|
| 1 | 0.035 | — | 13/16 Hex | 79.4 | 81.7 | 12.5 | 50.6 |
| 2 | 0.035 | 0.28 | ⅞ Hex | 72.9 | 78.4 | 15.0 | 54.7 |
| 3 | 0.030 | 0.31 | 1 3/16 Hex | 75.7 | 76.7 | 12.5 | 46.0 |
| 4 | 0.025 | 0.26 | 1 11/16 Hex | 69.2 | 74.9 | 11.5 | 42.9 |
| 5 | 0.035 | — | ⅝ Round | 74.9 | 78.7 | 12.0 | 50.4 |
| 5 | 0.041 | — | 1 1/16 Hex | 78.2 | 78.9 | 11.0 | 45.8 |
| 6 | 0.044 | — | 13/16 Round | 78.1 | 80.1 | 12.7 | 52.5 |
| 7 | 0.044 | 0.30 | ⅞ Round | 78.3 | 81.0 | 11.3 | 51.5 |
| 8 | 0.089 | — | 1 1/16 Round | 79.6 | 81.6 | 12.5 | 46.9 |
| 9 | 0.035 | — | ⅝ Hex | 72.4 | 80.7 | 18 | 50 |
| 9 | 0.035 | — | 15/32 Round | 72.9 | 81.5 | 19 | 52 |

TABLE 2-continued

Effect of Columbium on Mechanical Properties and Machinability of Cold Drawn Bars

| Steel | Cb, % | Pb, % | Size/Shape | Mechanical Properties: Yield Strength ksi | Tensile Strength ksi | Elong. % | R/A % |
|---|---|---|---|---|---|---|---|
| 12L14 | — | 0.15/ 0.35 | 13/16 thru 1⅞ Hex ⅝ thru 2¼ Round | Mean 63.5 62.7 | Mean 66.7 65.9 | Mean 12.1 12.5 | Mean 43.5 46.7 |

TABLE 3

| Steel | Size/Shape | Tool Life, hrs/grind: Drill | Rough Form | Finish Form | Cut-off |
|---|---|---|---|---|---|
| 9 | ⅝ Hex | 18.1 | 65.2 | 57.9 | 6.3 |
| | 15/32 Round | 12.3 | 48.7 | 61.7 | 5.9 |
| 10 | ⅝ Hex | 11.2 | 34.5 | 56.3 | 3.7 |
| | 15/32 Round | 6.9 | 46.8 | 65.1 | 4.6 |
| 11 | ⅝ Hex | 5.1 | 12.8 | 21.4 | 2.1 |
| | 15/32 Round | 2.3 | 10.2 | 22.1 | 1.8 |

The embodiments of the invention in which an exclusive property or privilege is claimed are defined as follows:

1. A cold drawn resulfurized and rephosphorized free-machining steel bar formed by cold drawing a hot rolled steel bar having the composition, consisting essentially of, by weight:

C up to 0.08%
Mn 0.6% to 1.4%
Si up to 0.1%
P 0.03% to 0.09%
S 0.25% to 0.50%
Cb 0.02% to 0.10%
the sum of Ni, Cr, Mo, and Cu up to 0.15%, and balance iron.

2. The cold drawn steel bar of claim 1 further characterized in that the ratio of % Mn/% S is from 1.6 to 4.0 and the ratio of [% Mn−(1.62×% S)]/% Cb is from 2 to 50.

3. The cold drawn steel bar of claim 1 further including Pb in an amount, by weight, of 0.03% to 0.35%.

4. The cold drawn steel bar of claim 1 further including Zr in an amount, by weight, of from 0.005% to 0.05%.

5. The cold drawn steel bar of claim 1 further including Bi in an amount, by weight, of from 0.05% to 0.25%.

6. The cold drawn steel bar of claim 1 further including, by weight, Pb in an amount of from 0.03% to 0.15% and Bi in an amount from 0.05% to 0.15%.

7. The cold drawn steel bar of claim 1 further including N in an amount, by weight, of from 0.006% to 0.012%.

8. The cold drawn steel bar of claim 1 further including, by weight, Bi in an amount from 0.05% to 0.25% and Te in an amount from 0.005% to 0.05%.

9. The cold drawn steel bar of claim 1 further including, by weight, V in an amount up to 0.1%.

10. The cold drawn steel bar of claim 1 further characterized in that the yield strength and tensile strength are increased without any substantial decrease in ductility when applying a heavy draft to the bar with Cb and a reduced amount of carbon.

11. The cold drawn steel bar of claim 10 further characterized in that the draft in cold drawing for bars of one inch and more is at least ⅛ inch.

12. The cold drawn steel bar of claim 10 further characterized in that the draft in cold drawing for bars less than one inch is between 15 and 30 percent of the area of the bar in a hot rolled state.

13. A cold drawn resulfurized and rephosphorized free-machining steel bar in which the yield strength and tensile strength are increased without any substantial decrease in ductility, said bar being formed by cold drawing a hot rolled steel bar with the draft in such cold drawing being between 15% and 30% of the area of the bar in a hot rolled state, said hot rolled steel bar having the composition, consisting essentially of, by weight:

C up to 0.08%
Mn 0.6% to 1.4%
Si up to 0.1%
P 0.03% to 0.09%
S 0.25% to 0.50%
Cb 0.035% to 0.09%
the sum of Ni, Cr, Mo, and Cu up to 0.15%, and balance iron.

* * * * *